US005452042A

United States Patent [19]

Pummell

[11] Patent Number: 5,452,042

[45] Date of Patent: Sep. 19, 1995

[54] PROCESSING UNIT

[75] Inventor: Leslie J. Pummell, Rickmansworth, United Kingdom

[73] Assignee: Eastman Kodak Company, Rochester, N.Y.

[21] Appl. No.: 166,114

[22] Filed: Dec. 13, 1993

[30] Foreign Application Priority Data

Dec. 16, 1992 [GB] United Kingdom ..... 9226175

[51] Int. Cl.[6] ..... G03D 3/08

[52] U.S. Cl. ..... 354/321; 354/322; 354/331; 354/336

[58] Field of Search ..... 354/319–324, 354/331, 336; 134/64 P, 64 R, 122 P, 122 R

[56] References Cited

U.S. PATENT DOCUMENTS

| | | | |
|---|---|---|---|
| 4,034,389 | 7/1977 | Huss | 354/322 |
| 4,673,273 | 6/1987 | Yoshimi | 354/322 |
| 4,941,008 | 7/1990 | Nakamura | 354/320 |
| 4,987,438 | 1/1991 | Goto et al. | 354/319 |
| 4,994,839 | 2/1991 | Yamakoshi | 354/322 |

FOREIGN PATENT DOCUMENTS

| | | | |
|---|---|---|---|
| 491049 | 6/1992 | European Pat. Off. | 354/323 |
| 63-167362 | 7/1988 | Japan | 354/323 |
| 1-225954 | 9/1989 | Japan | 354/323 |
| 90/08981 | 8/1990 | WIPO . | |

*Primary Examiner*—D. Rutledge
*Attorney, Agent, or Firm*—Frank Pincelli

[57] ABSTRACT

A processing unit comprising a plurality of tanks. Each tank is designed to contain a respective one of different processing solutions which are to be used at different stages of the process and having transport mechanisms by which material to be treated therein is introduced into the tank for processing and for transporting the material out of the tank to the next tank for treatment in each tank in turn. The transport mechanism by which material to be treated in one of the tanks is transported out of that one tank is at a higher level by which treated material is introduced into the next tank.

9 Claims, 3 Drawing Sheets

PROCESSING UNIT

FIELD OF THE INVENTION

This invention relates to a processing unit, particularly, but not exclusively, for treating photographic material such as film and comprising a plurality of tanks, each tank being intended to contain a respective one of different processing solutions which are to be used at different stages of the process and having means by which material to be treated in it is introduced into it for processing in the solution in it and means by which treated material is transported out of it.

BACKGROUND OF THE INVENTION

The means by which material to be treated is introduced into each of the tanks and the means by which it is transported out of the tank are means by which other liquid can gain unintended access to the interior of the tank and contaminate the processing solution contained in that tank. If the numerous processing tanks, and more particularly the means by which material to be treated is introduced into each of the tanks and the means by which treated material is transported out of the tanks are all at the same level, which, at least as far as photographic material such as film is concerned, is desirable for various reasons such as to minimize crossover distance and thus time spent by the treated material in the atmosphere during transfer of the material from one tank to another, to facilitate heating of the tank in a water bath, and to simplify forming the tanks as a one piece molding, there is a risk that the processing solution in one of the tanks may be contaminated by liquid from another tank because it is possible that liquid from one tank may splash into another.

In particular, contamination of photographic developer solution with another processing solution could result in damage to a film. That can be a problem when processing black and white film, but it is a far greater problem with development of color film because a greater number of different solutions are used in color development with differing degrees of undesirable consequences when one contaminates another. One of those other solutions used in color development is bleach and contamination of the developer solution with bleach would result in the spoiling or even destruction of the latent images on a customer's film. This is one of the worst things that could happen to a customer's film.

Photographic film processing machines, in particular minilab processors, are usually operated in fixed locations by people with little chemical knowledge, Under these circumstances they may not appreciate the importance of keeping the processing tanks, especially the developer tank, free from contamination by other chemicals.

There is a greater risk of such contamination where the processing machine is mounted on a moving platform, say on a ship, an airplane, a train or a lorry as motion of the platform may cause splashing of the chemical solutions in the tanks and that may lead to contamination. It is quite possible that the operator will not notice such contamination occurring or may not realize the problems that may ensue. Even if such contamination were to be noticed, the necessary remedial action would involve considerable waste of time and materials.

DISCLOSURE OF THE INVENTION

According to this invention there is provided a processing unit comprising a plurality of tanks, each tank being intended to contain a respective one of different processing solutions which are to be used at different stages of the process and having means by which material to be treated in it is introduced into it for processing in the solution in it and means by which treated material is transported out of it, and material transport means operable to transport material from tank to tank for treatment in each tank in turn, wherein the means by which material to be treated in one of the tanks is transported out of that one tank are at a higher level than are the means by which that treated material is introduced into the next tank to which that treated material is transported by the material transport means.

Although the greater risk of contamination of the processing solution in said one tank is by unintended access through said means by which material to be treated in it is transported out of it, there is some risk of contamination by unintended access through said means by which material to be treated in it is transported into it. Accordingly it is preferred that the means by which material to be treated is introduced into said one tank are at a higher level than are the means by which material treated in said one tank is introduced into the next tank. It is also preferred that the means by which material to be treated in said one tank is introduced into it and/or the means by which material treated in said one tank is transported out of it are at a higher level than are the means by which material treated in the next tank is transported out of that next tank. In a preferred embodiment the means by which material to be treated in said one tank is introduced into it and the means by which material treated in said one tank is transported out of it are at a higher level than are the corresponding means of any of the other tanks that contain solutions which could contaminate the solution in said one tank undesirably if mixed therewith. Furthermore each tank is conveniently arranged so that said means by which material to be treated in it is introduced into it are at the same level as are said means by which material treated in it is transported out of it.

The means by which material to be treated is introduced into the next tank and the means by which treated material is transported out of that next tank may be at a higher level than are the corresponding means of a further one or more of the other tanks that contain other solutions which would contaminate the solution in that next tank undesirably if mixed therewith.

Preferably the unit is a photographic processing unit and the solution that said one tank is to contain is the developer solution.

An inevitable consequence of arranging the developer tank so that its means operable to transport treated photographic material out of it to the next tank of the unit are higher than the means by which that treated material is introduced into the next tank is that the path between the two tanks is longer than it is if they are at the same level. That is not an option with conventional photographic film processing units because the film speed is so slow that the greater time exposed to the atmosphere would be intolerable nor is it an option to increase the speed of the photographic material in such processing units because the photographic material would not be immersed in the developer solution for the required time. Accordingly the preferred form of processing unit in which the present invention is embodied is one which is provided with means operable to immerse photographic material in processing solution in each tank for a time which is selectable separately from the setting of the speed at which that material is transported through the unit, means operable to select the speed of transport of the photographic material through the unit and to select the time of immersion of photographic material in processing solution in each tank being provided together with means operable at the end of that time to initiate transport of that photographic material out of each tank. Hence, in the preferred embodiment the material transport means are operable to transport material from the developer tank sufficiently quickly for the time in which the material is not immersed in the developer solution in that tank after being immersed in that developer solution to be less than a predetermined time.

Preferably said means operable to immerse photographic material in processing solution in each tank comprises means operable to circulate the photographic material around within the tank immersed within the solution in the tank for said selected time and said means operable to initiate transport of that photographic material out of the tank comprise means operable to selectively deflect the photographic material either for further circulation within the tank immersed in solution in the tank or out of the tank, there being provided means operable to control operation of said deflecting means independently of setting of the speed of the photographic material. Conveniently the means of each tank operable to circulate photographic material around within that tank are driven by common drive means.

The tanks may be modular tanks individually mountable within structure of the unit.

A tank which is to contain such another solution which would contaminate the solution in said one tank may be formed with an inwardly curved tank wall portion at its top whereby solution in that tank which is slopped upwards is deflected back into the tank by the inwardly curved tank wall portion.

Shield means positioned to shield said one tank and/or any of the other tanks from solution being splashed into it from one of the other tanks may be provided. There may be gate means in such shield means operable to allow passage through said shield means from one tank to another of material to be treated in such another tank. A floatable cover may be inserted into a respective one of the tanks so as to float on solution within that tank and thereby minimize the exposed surface area of the solution within that tank.

The processing unit may be mounted in a gimbal frame which is for mounting the unit on a mobile platform. The unit may be adapted to be mounted on a mobile platform which is part of a vehicle, wherein the unit is adapted to be mounted with the developer tank at its rear in the sense of the direction of forward travel of the vehicle.

One embodiment of this invention is described now by way of example with reference to the accompanying drawing which is a diagrammatic illustration of the developer and bleach tanks of a mini-lab color film photographic processor machine in which the invention is embodied. The machine is of the kind described and illustrated in our PCT International Patent Publication No. W090/08981.

The machine has a number of similar, individually mounted modular tanks, each containing a different processing solution. In each tank there is a so-called 'rack mechanism' which is operable to circulate a length of film along its length around a closed-loop path immersed in the respective processing solution for a predetermined number of times. The time taken to circulate the film around the closed loop path for the predetermined number of times is substantially the optimum time for the film to be immersed in the developer solution. When the film has been so cycled for the predetermined number of times, a switch mechanism is actuated to deflect the film out of the closed loop path and to direct it to a film transfer mechanism by which it is fed out of the tank and into the next tank where it is taken up by the rack mechanism of that next tank and circulated around the respective closed loop path in that tank for the predetermined number of times. The rack mechanisms of all the tanks are driven by a common drive shaft so that the film is moved at a constant speed within and between the tanks. Since the film can be circulated within each tank for several circuits of the closed loop path, the speed can be fast so that the time taken for transfer through air between juxtaposed tanks is minimized. It will be understood that the time the film spends immersed in the processing solution in each tank is not dependent solely upon its speed but also on the number of times it is cycled around the tank and that can be set independently of setting the speed.

BRIEF DESCRIPTION OF THE DRAWINGS

There is illustrated in schematic form in FIGS. 1–4 a developer tank and bleach tank for use in a processing unit made in accordance with the present invention.

DESCRIPTION OF THE PREFERRED EMBODIMENTS

Figure 1:
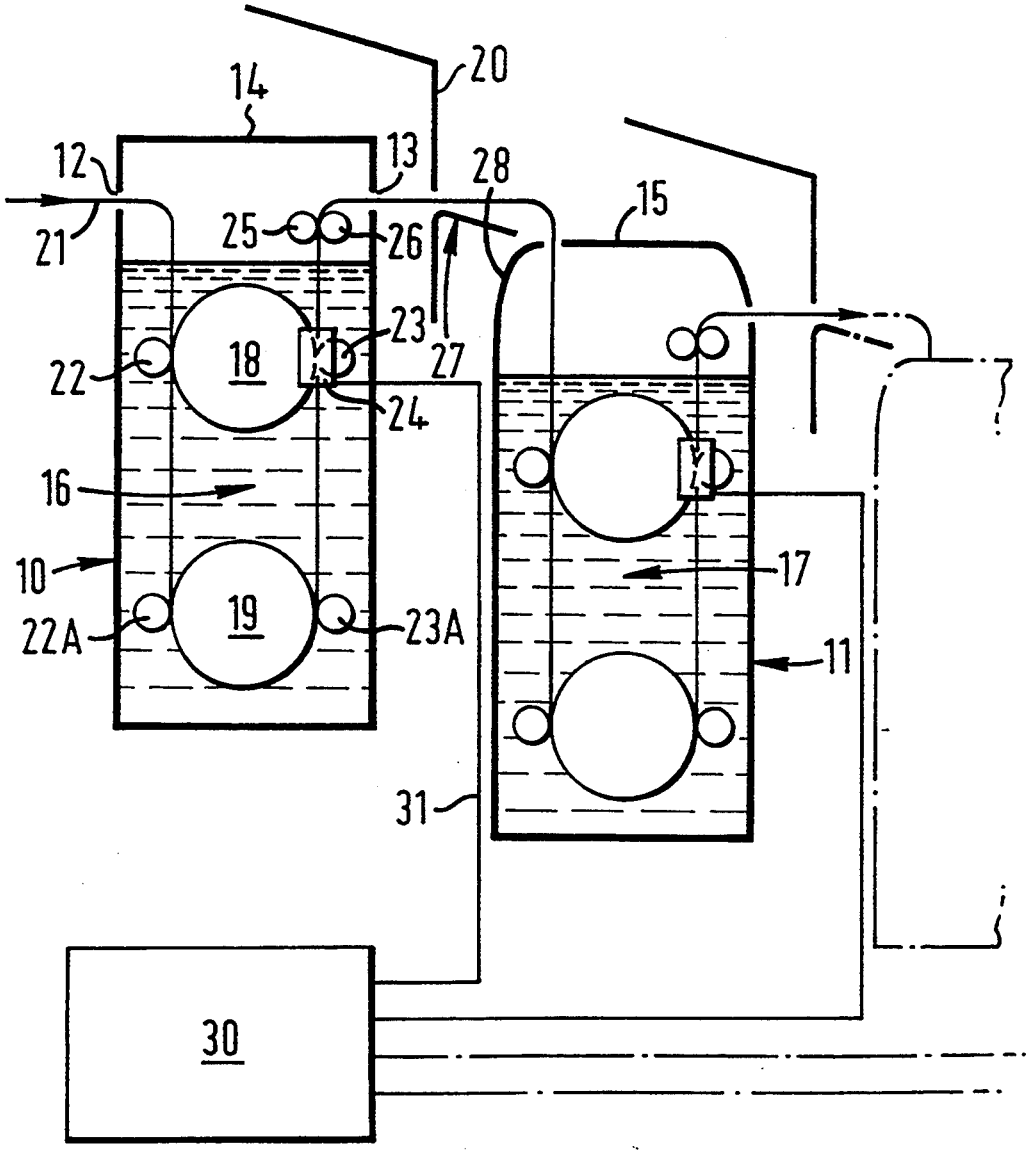
Figure 2:
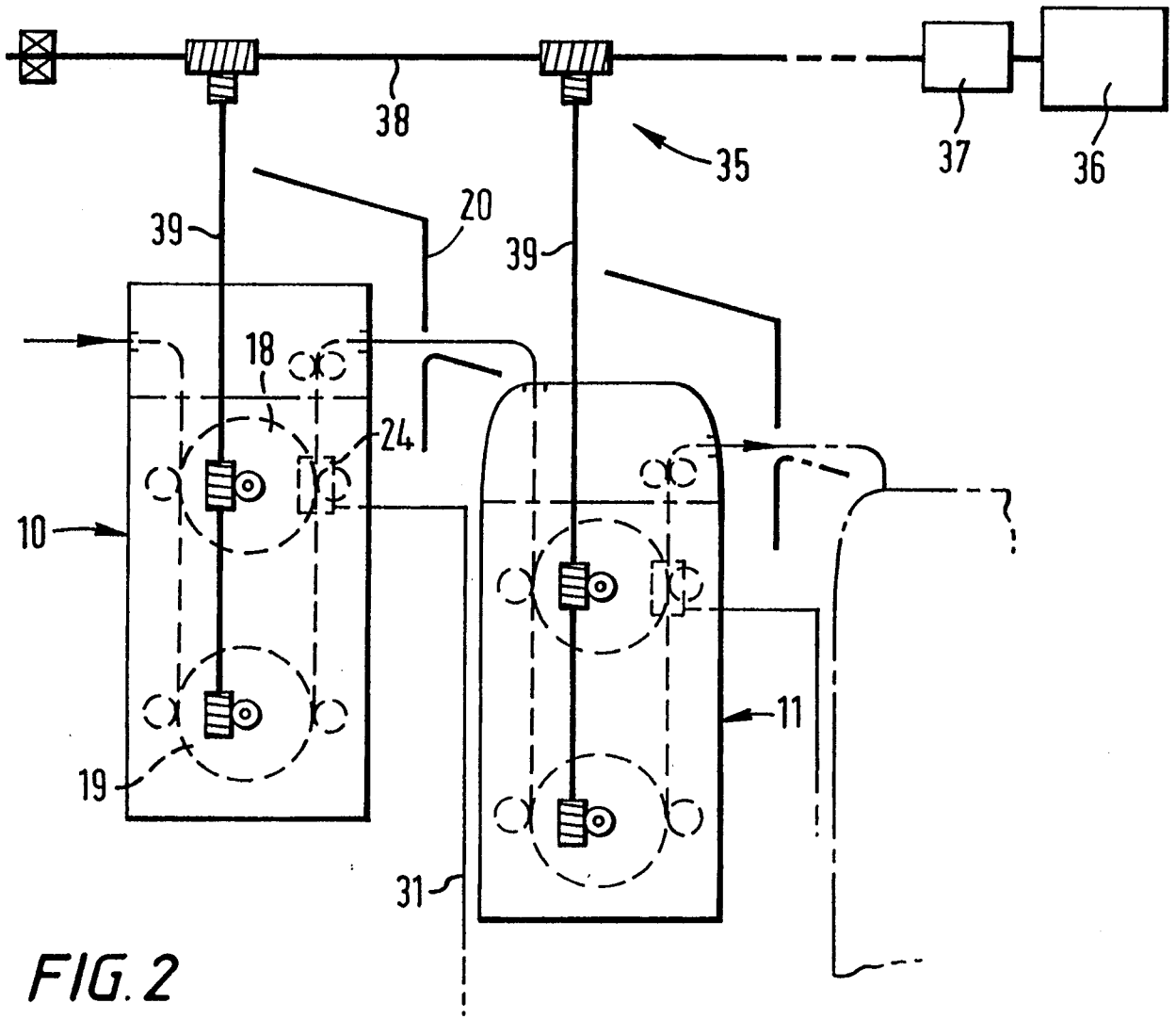
Figure 3:
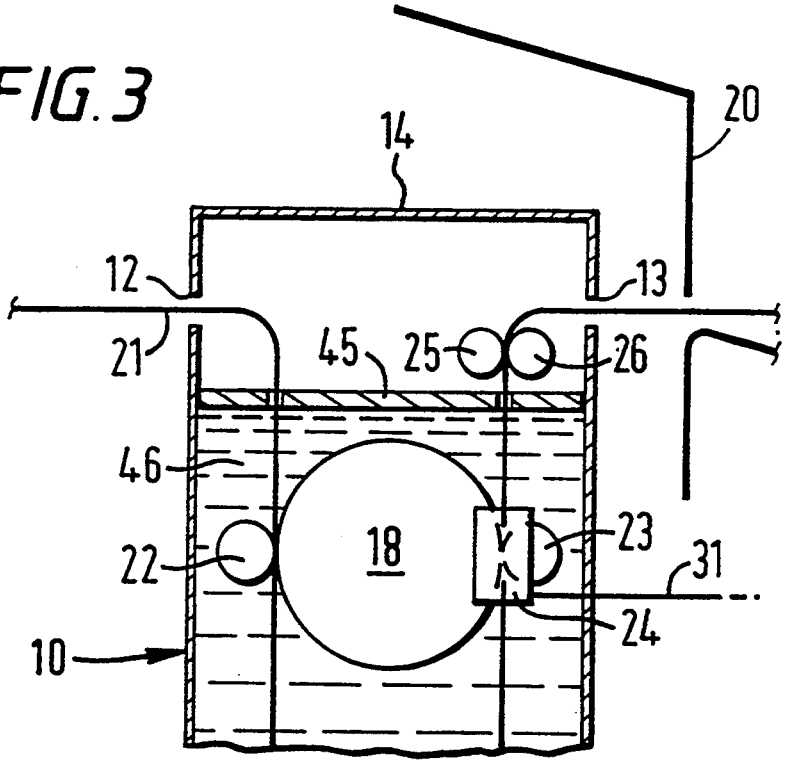
Figure 4:
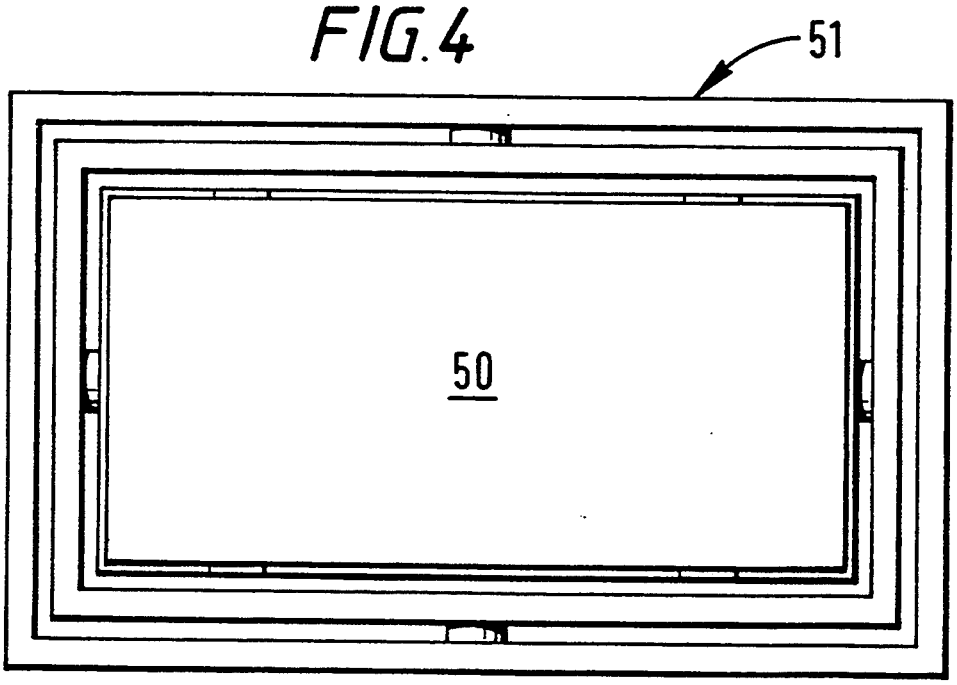

The drawing shows the developer tank 10 is higher than the bleach tank 11. Thus the apertures 12 and 13 through which film is fed into and out from the developer tank 10 and the open top 14 of the developer tank 10 are above the open top 15 of the bleach tank 11. The modular form of the tanks facilities their being mounted at different levels. The other tanks of the machine are not shown but they would be downstream of the bleach tank 11 in the sense of the direction in which film to be processed is transferred from each tank to the next and thus to the right of the bleach tank 11 as shown in the drawing. They would also be lower than the developer tank 10 and one could be lower than another if there is a further risk of contamination of the solution in the higher of the two by solution from the lower one.

The rack mechanism of the developer tank 10 is generally indicated at 16 and that of the bleach tank 11 at 17. They are similar and that of the developer tank 10 will be described in more detail by way of example. It conveniently comprises a pair of driven rollers 18 and 19 journalled in support structure so as to rotate one above the other. They are driven by the common drive mechanism (not shown) of the processor machine. Film 21 introduced into the machine for processing is fed by appropriate input feed means through the aperture 12 and directed between the upper driven roller 18 and a co-operating squeegee nip roller 22 by which is directed towards the lower driven roller 19. The film 21 is passed between a lower squeegee nip roller 22A and the lower roller 19, around the lower roller 19 and between the lower roller 19 and another squeegee nip roller 23A. It is then returned to the upper driven roller 18, being fed between that driven roller 18 and another squeegee nip roller 23. A switch mechanism 24 is provided near to the squeegee nip roller 23. It has two settings. In the first setting it directs the film 21 around the upper driven roller 18 to be fed downwards to the lower driven roller 19 between the squeegee nip roller 22 and the upper driven roller 18. In the alternative setting to which it is switched when the film 21 has been cycled around the two driven rollers 18 and 19 for a predetermined number of times whilst being totally immersed in the developer solution in the developer tank 10, it deflects the film 21 away from the upper driven roller 18 directly upwards to be fed between a pair of squeegee nip rollers 25 and 6 from which it is passed by a film transfer mechanism (not shown) out through the outlet aperture 13 of the developer tank 10, through a gate and shield arrangement 27 and into the bleach tank 11 being directed towards the rack mechanism 17 mounted therein.

The upper edge of the bleach tank 11 is formed by an inwardly-curved tank wall portion 28 which helps to reduce the risk of bleach splashing out of the tank 11, since any bleach in that tank 11 which was slopped upwards would tend to be deflected back into the tank 11 by the inwardly curved wall portion 28 if it struck that wall portion 28.

The mounting of the developer tank 10 above the bleach tank 11 leads to a reduction in the chance of bleach splashing into the developer and contaminating it. That risk is further reduced by the use of the shields and the gate arrangement, and also by the use of floating covers which are inserted through the open tops of the tanks so that they float on the top of the solution in those tanks in order to minimize evaporation.

A processing unit in which this invention is embodied is suitable for use when mounted on a mobile platform such as in a ship, a plane, a train or a lorry where there is a risk of splashing of the chemical solution in the tanks. The unit may be mounted in a gimbal frame on such a moving platform in order to reduce the risk of splashing. In the case where the unit is mounted on a vehicle, such as a train, it would be expedient to arrange it with the developer tank at the rear of the unit, in the sense of the forwards direction of travel so that, in the event of sudden braking solution would tend to surge up and splash away from the developer.

It will be understood the machine could be used for developing black and white photographic material in which case treated material transported out of the developer tank 10 would bypass the bleach 11 and be directed directly to the next tank appropriate for black and white processing.

Parts List

10 . . . developer tank
11 . . . bleach tank
12,13 . . . apertures
14 . . . open top
15 . . . open top
16,17 . . . rack mechanism
18,19 . . . driven rollers
21 . . . film
22 . . . squeegee nip roller
22A . . . lower squeegee nip roller
23 . . . squeegee nip roller
23A . . . squeegee nip roller
24 . . . switch mechanism
25,26 . . . pair of squeegee nip rollers
27 . . . shelf arrangement
28 . . . tank wall portion

I claim:

1. A processing unit for processing a material by directing the material through a plurality of treatment stages, the unit comprising:

a plurality of processing tanks corresponding to a respective one of the plurality of treatment stages, each processing tank containing a processing solution for effecting treatment of the material in that treatment stage, each processing tank having an inlet and an outlet through which material being processed is respectively introduced into and removed from that processing tank, the outlet from one processing tank being higher than the inlet of the next processing tank; and transport means for transporting the material being treated through each one of the plurality of processing tanks and from processing tank to processing tank;

wherein the processing tanks are modular tanks individually mounted within the processing unit and positioned so that the material being processed passes from one tank to the next in a generally horizontal plane.

2. A unit according to claim 1, wherein the inlet of one processing tank is at a higher level than the inlet of the next processing tank.

3. A processing unit according to claim 1, wherein at least one processing tank is formed with an inwardly curved tank wall portion at its top whereby solution in that processing tank which is slopped upwards is deflected back into the tank by the inwardly curved tank wall portion.

4. A unit according to claim 1, including shield means positioned to shield each processing tank from solution being splashed into it from any one of the other processing tanks.

5. A processing unit according to claim 4, including gate means in the shield means operable to allow passage of the material to be processed from one processing tank to another.

6. A processing unit according to claim 1, including a floatable cover inserted into a respective one of the processing tanks so as to float on solution within that processing tank and thereby minimize the exposed surface are of the solution within that processing tank.

7. A processing tank according to claim 1, mounted in a gimbal frame which is for mounting the unit on a mobile platform.

8. A processing unit according to claim 1, wherein the processing unit is a photographic processing unit, at least one tank containing developer solution.

9. A processing unit according to claim 8, wherein the photographic processing unit is adapted to be mounted on a mobile platform which is part of a vehicle, the unit being mounted such that the processing tank containing developer solution is mounted at the rear of the vehicle in the sense of the direction of forward travel of the vehicle.

* * * * *